US005813736A

United States Patent [19]

Ballew

[11] Patent Number: 5,813,736

[45] Date of Patent: Sep. 29, 1998

[54] CABINET STORAGE DEVICE

[76] Inventor: Ann Ballew, 3309 E. Elm, El Reno, Okla. 73036

[21] Appl. No.: 707,901

[22] Filed: Sep. 12, 1996

[51] Int. Cl.[6] ..... A47B 88/20

[52] U.S. Cl. ..... 312/249.9; 312/249.8; 312/330.1; 312/348.3

[58] Field of Search ..... 312/319.5, 249.8, 312/249.9, 249.11, 319.8, 348.3, 312, 242, 245, 330.1; 5/18.1

[56] References Cited

U.S. PATENT DOCUMENTS

| | | | |
|---|---|---|---|
| 231,478 | 8/1880 | Curry . | |
| D. 351,079 | 10/1994 | Brown | 312/249.8 X |
| 2,250,148 | 7/1941 | Bonnet et al. | 5/18.1 |
| 2,418,919 | 4/1947 | Benson | 312/330.1 |
| 2,510,759 | 6/1950 | Schnewind . | |
| 2,774,644 | 12/1956 | Patterson . | |
| 2,950,158 | 8/1960 | Harmon | 312/330.1 X |
| 3,073,431 | 1/1963 | Davis et al. . | |
| 3,664,719 | 5/1972 | Berg . | |
| 4,155,609 | 5/1979 | Skafte et al. | 312/245 |
| 4,170,800 | 10/1979 | Wiberg | 5/18.1 X |
| 4,261,626 | 4/1981 | Hornbacher | 312/249.9 X |
| 4,318,575 | 3/1982 | Redlich | 312/249.9 |
| 4,669,790 | 6/1987 | Briggs | 312/249.9 X |
| 4,756,412 | 7/1988 | Graves et al. . | |
| 4,784,446 | 11/1988 | Newhouse | 312/249.8 X |
| 4,811,996 | 3/1989 | Hansson . | |
| 4,984,854 | 1/1991 | DeLavallade . | |
| 5,087,107 | 2/1992 | Fumanelli | 312/249.11 X |
| 5,117,971 | 6/1992 | Fisher . | |
| 5,261,529 | 11/1993 | Holland . | |
| 5,411,139 | 5/1995 | Victory . | |

FOREIGN PATENT DOCUMENTS

| | | | |
|---|---|---|---|
| 4223626 | 1/1994 | Germany | 312/249.8 |
| 4109908 | 4/1992 | Japan | 312/249.11 |

*Primary Examiner*—Peter M. Cuomo
*Assistant Examiner*—Hanh V. Tran
*Attorney, Agent, or Firm*—Robert Treece

[57] ABSTRACT

A cabinet storage device for use in cabinets such as kitchen cabinets. The storage device includes generally vertical panels for hanging items on and the panels. The panels may be extended outwardly from the cabinet to provide easy access to items which may be suspended from the panels and support means may be included to provide additional support for the panels when they are extended from the cabinet.

5 Claims, 4 Drawing Sheets

CABINET STORAGE DEVICE

BACKGROUND OF THE INVENTION

1. Field of the Invention

The present invention relates to cabinet storage devices having vertical pull out panels for hanging items on.

2. Description of the Prior Art

Cabinets, such as kitchen cabinets and the like are in common use and particularly cabinets which are commonly called "lowers." Lowers are those cabinets which rest upon the floor and commonly include a row of drawers along the top and several shelves below that. The prior art lower cabinet shelves are generally used to store cooking utensils, and other items commonly needed in the room. One of the disadvantages of this arrangement is that one must often bend down and reach to the rear of a shelve when trying to retrieve an item which has been stored there. This bending and reaching are inconvenient enough, but in addition since items are commonly stacked on the shelves one may be required to move or even remove many items while looking for the desired item. The requirement of bending, reaching and digging around is not only inconvenient but is often difficult, or even impossible, for one of advanced age or one who is laboring under a disability.

SUMMARY OF THE INVENTION

In view of the foregoing disadvantages inherent in the known types of cabinets now present in the prior art, the present invention provides an improved cabinet construction wherein the same can be utilized reliably in those situations where increased accessability is desired or required. As such, the general purpose of the present invention, which will be described subsequently in greater detail, is to provide a new and improved cabinet storage device which has all the advantages of the prior art cabinet devices and none of the disadvantages.

To attain this, the present invention essentially comprises one or more generally vertical panels which will extend horizontally from the cabinet. The panels have a plurality of hooks, baskets and the like movably connected thereto for hanging or holding items to be stored. The panels may be built into new cabinets or may be added to existing cabinets. In addition, support structures may be added to support the weight of a panel and its contents when extended from the cabinet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cabinet storage device which may be easily and efficiently manufactured and marketed.

It is a further object of the present invention to provide a new and improved cabinet storage device which is of a durable and reliable construction.

An even further object of the present invention is to provide a new and improved cabinet storage device which is susceptible of a low cost of manufacture with regard to both materials and labor, and which accordingly is then susceptible of low prices of sale to the consuming public thereby making such cabinet storage device economically available to the buying public.

Still another object of the present invention is to provide a new and improved cabinet storage device which provides some of the advantages found in the apparatuses and methods of the prior art, while simultaneously overcoming some of the disadvantages normally associated therewith.

Another object of the present invention is to provide a new and improved cabinet storage device which extends from a cabinet to provide easy access to stored items.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
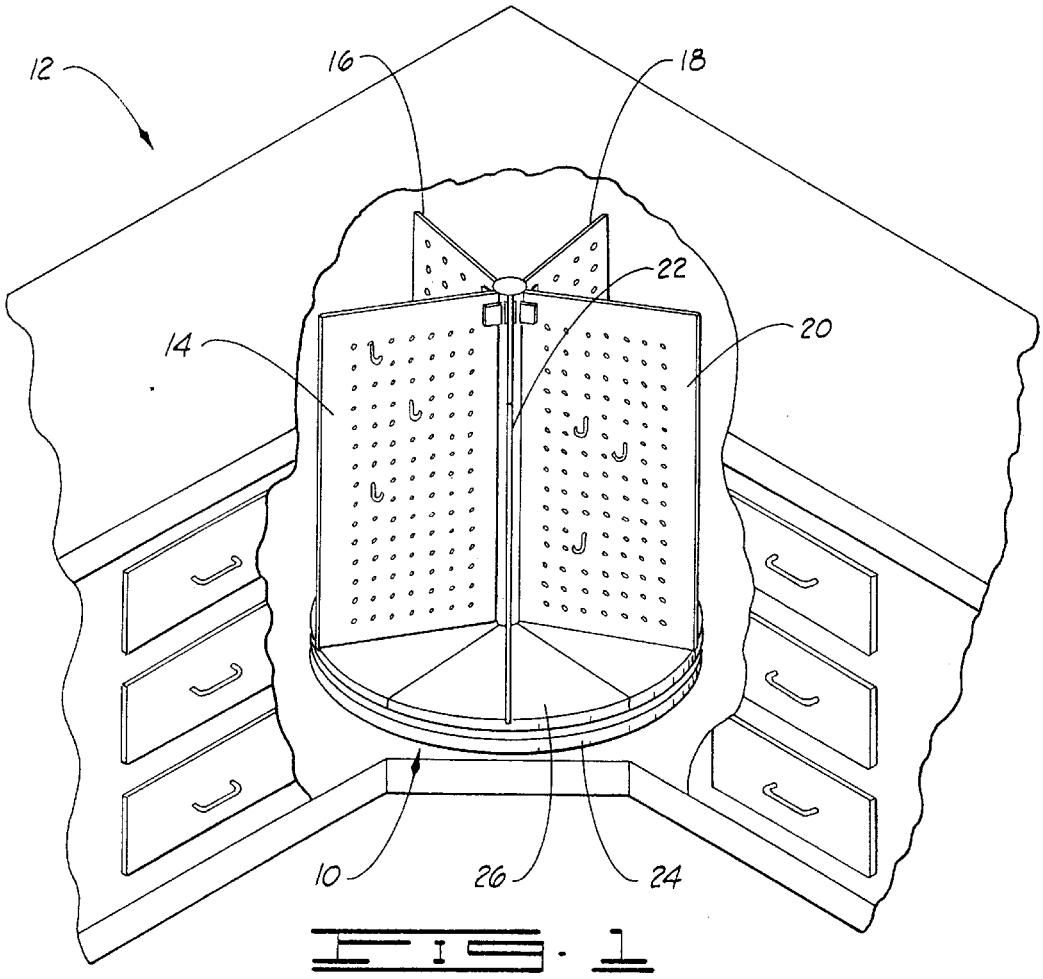
FIG. 1 is a perspective view of a cabinet having a cabinet storage device constructed in accordance with the present invention.

Referring to the drawings in detail and to FIG. 1 in particular, reference character 10 generally designates a cabinet storage device constructed in accordance with the present invention and reference character 12 designates a cabinet in which the cabinet storage device is installed. In this embodiment, vertical panels, such as vertical panels 14, 16, 18, 20 and 22, are mounted upon a rotating platform 24. In this way any of the vertical panels may be rotated to the front of the cabinet 12 for access. In addition the vertical panels are connected to individual sliding bases such as sliding base 26 (only one sliding base being referenced in FIG. 1). It should also be noted that while five panels 14, 16, 18, 20 and 22, are shown in FIG. 1, any number of panels may be used, however it is believed that six panels provide the most efficient use of space.

Figure 2:
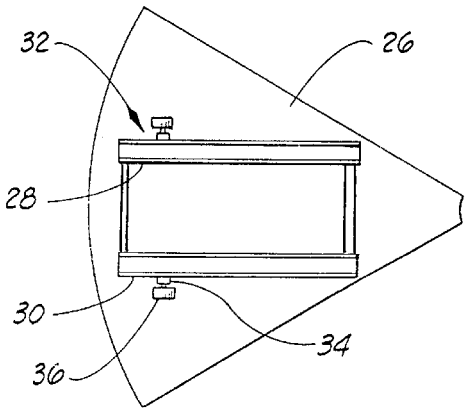
FIG. 2 is a bottom plan view of the cabinet storage device shown in FIG. 1.
Figure 2A:
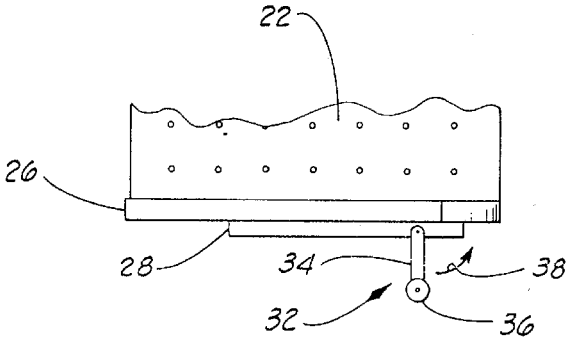
FIG. 2A is an elevational view of a portion of the cabinet storage device of FIG. 1 in an extended position and showing a support therefor.

Referring now to FIG. 2, shown therein is a bottom plan view of the sliding base 26. Mounted thereon are slide rails 28 and 30. The addition of the slide rails 28 and 30 allow the sliding base 26 to slide horizontally outward away from the rotating platform 24. The slide rails 28 and 30 are connected to the sliding base 26 and to the rotating platform 24. In this way the panel 22 is extended horizontally away from the cabinet 12 to provide easy access to the items which may be hung from the panel. While two slide rails 28 and 30 are shown in FIG. 2, a single slide rail or more than two slide rails may be used.

Figure 3:
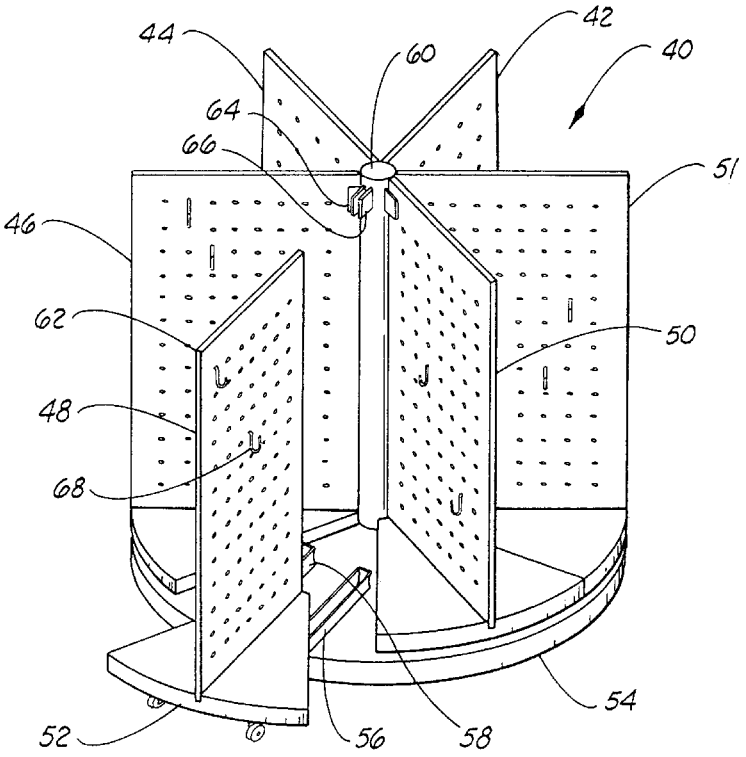
FIG. 3 is a perspective view of the cabinet storage device showing a panel extended therefrom.

Preferably each slide rail also has support means, such as support member 32, to provide additional support for the sliding base 26 when the base is extended outwardly from the rotating platform 24. As shown in FIG. 2, the most preferred embodiment the support member includes a retractable arm 34 having one end pivotally attached to a slide rail and having a wheel 36 rotatably attached to the opposing or second end. The retractable arm 34 may be biased by a spring or may use gravity to cause it to extend downwardly to rest on the floor and thereby support the sliding base 26 it is in the extended position such as sliding base 52 (FIG. 3). When the sliding base is in the storage position such as is shown in FIG. 1, the arm pivots upwardly to a storage position. The wheel 36 engages the floor and allows the sliding base to be moved inwardly or outwardly while supplying sufficient support for the sliding base.

When the sliding platform 24 is pushed back into a storage position (such as is shown in FIG. 1) the arm 34 engages the rotating platform 24 causing the arm 34 to retract in the direction indicated by arrow 38.

FIG. 3 shows another embodiment of the cabinet storage device. In this embodiment the storage device 40 has six panels, 42, 44, 46, 48, 50 and 51. In this embodiment as with the previous embodiment, each panel is mounted so it will slide horizontally to provide easy access. For example, panel 48 is mounted on a sliding base 52. In the most preferred embodiment, the panels 42, 44, 46, 48, 50 and 51 are made from a strong material such as metal. However, by way of example, and not limitation, some other suitable materials include wood, particle board and plastic.

The sliding base 52 is connected to a rotating platform via one or more slide brackets. In the case of the embodiment shown in FIG. 3, two slide brackets 56, and 58 are used, but as mentioned before fewer or more brackets may be used provided sufficient lateral support is provided to hold the panel 48 in a generally vertical position. It should be kept in mind that items will be hung from the panel and the panel should be able to maintain its generally vertical position with such items connected thereto.

Means for providing additional support for the upper end of the panels may also be provided. By way of example and not limitation, one such suitable means is pole 60. The pole 60 is connected at its lower end to the rotatable platform 54 and extends upwardly therefrom. Preferably the pole 60 extends upwardly to about the same height as the upper end of the panels such as upper end 62 of panel 48. In this way clips or the like may be secured to the pole 60 for supporting the upper ends of the panels. As shown in FIG. 3 a pair of clips 64 and 66 are secured to the pole 60 such as by welding. The clips 64 and 66 are spaced apart so the upper end 62 of panel 48 can slide between the clips for support.

Each panel includes means for supporting items thereon. In the preferred embodiment the panels include a plurality of holes (such as hole 70) for receiving hooks or the like. The holes may be arranged in a regular geometric pattern or may be randomly spaces throughout the panel. FIG. 3 shows hooks 68 (only one hook being designated herein), but baskets, shelves, clips or the like may also be used. If baskets are used, each basket should have protrusions that are sized and shaped to attach to one or more of the holes in a panel so the basket can support items placed therein. Similar protrusions should be provided for shelves, clips or other holding means used.

Figure 4:
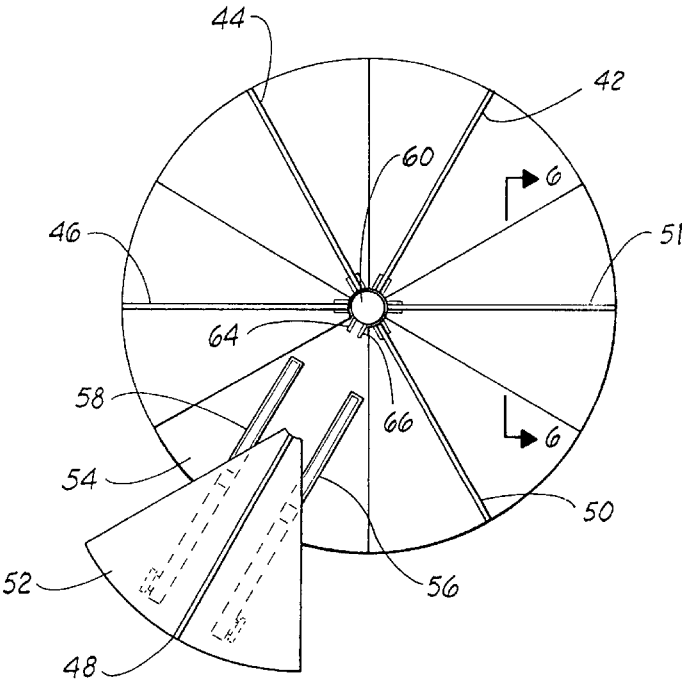
FIG. 4 is a top plan view of the cabinet storage device of FIG. 3.

Referring now to FIG. 4, shown therein is a top plan view of the apparatus of FIG. 3. As may be seen here, the sliding base 52 moves outward in a generally horizontal plain by gliding on slide brackets 58 and 58. Since the vertical panel 48 is attached to the sliding base, it too moves outward to provide better access to items which may be attached to the panel. The pole 60 and the clips 64 and 68 remain stationary since they are fixed in relation to the rotating base 54.

Figure 5:
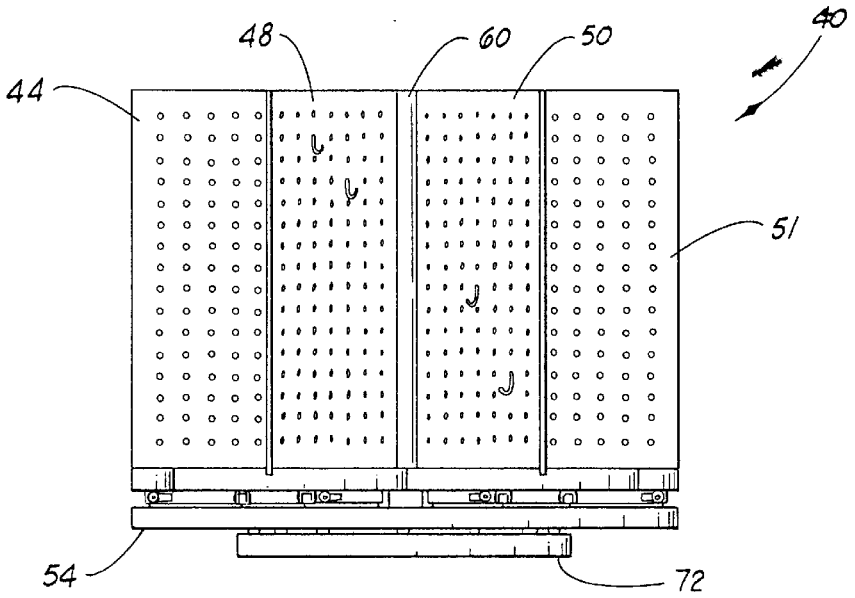
FIG. 5 is an elevational view of the cabinet storage device of FIG. 3.

FIG. 5 shows an elevation of the storage device 40. It should be noted that the storage device 40 includes a stationary base 72 upon which the rotating platform sits. In this way, the stationary base 72 supports the entire storage device 40 while allowing the panels to be rotated to provide easy access to an item they may be holding.

Figure 6:
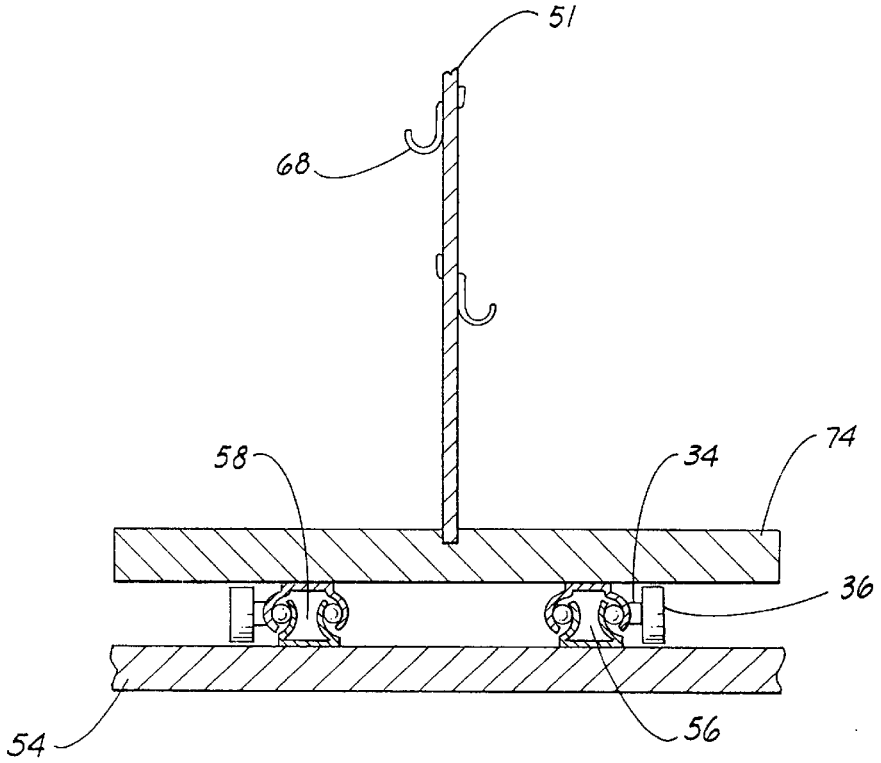
FIG. 6 is a cross-sectional view of a portion of the cabinet storage device of FIG. 4.

FIG. 6 shows an enlarged section of the device 40 along lines 6—6 of FIG. 4. From this view one may see that the panel 51 is secured to a sliding base 74. The connection is shown as a mortice connection, but any type of connection which will securely fasten the panel 51 to the sliding base 74 will work. The use of brackets, corner braces or the like may add additional strength to the connection and may be utilized. The retractable arm and wheel are shown in the retracted position and it may be seen that they fit between the sliding base 74 and the rotating platform 54. It may also be seen that the sliding base and the rotating platform are connected by a pair of slide brackets 56 and 58.

Figure 7:
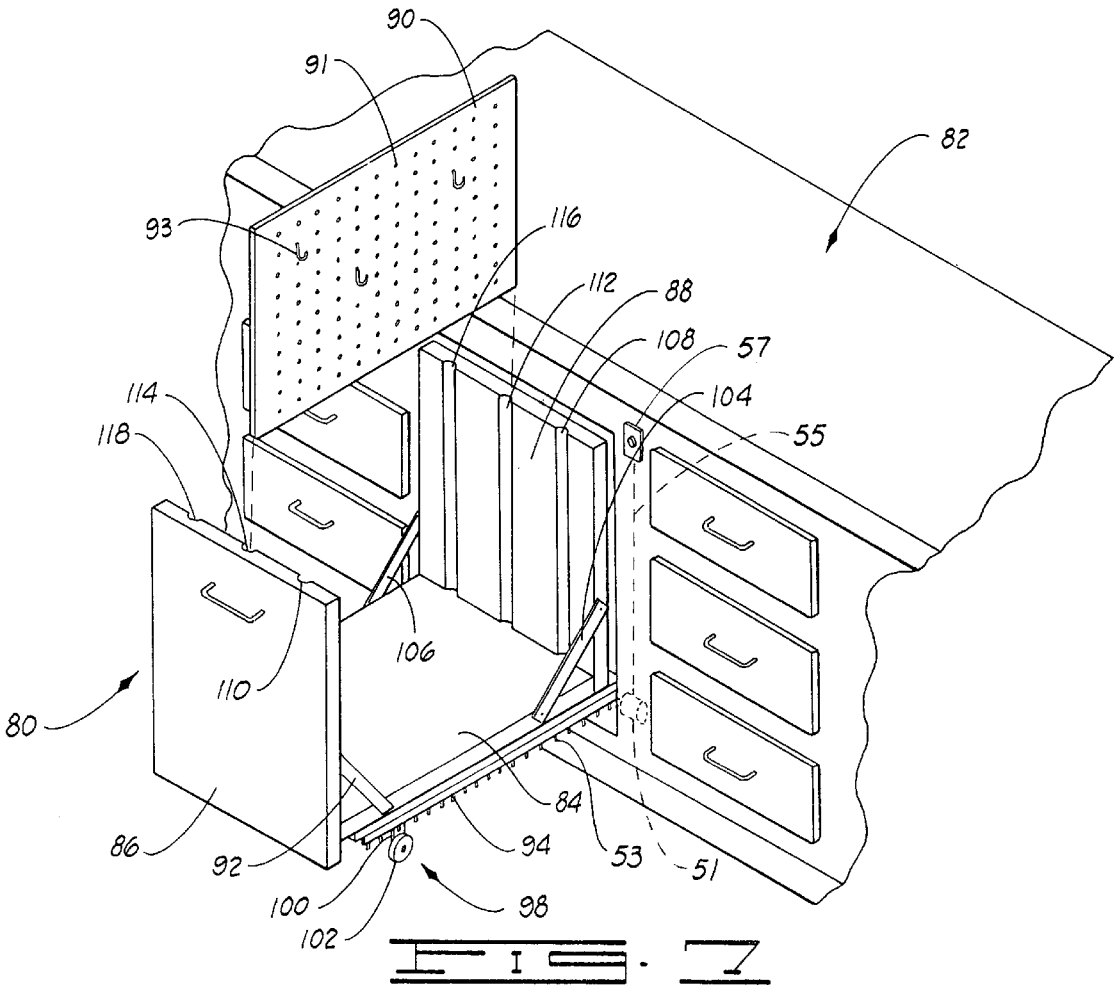
FIG. 7 is a perspective view of a cabinet having another embodiment of the cabinet storage device constructed in accordance with this invention.

FIG. 7 shows another preferred embodiment of the storage device. In this embodiment a storage device 80 is installed along the length of a cabinet 82. The storage device may be retrofitted to replace a cabinet door and shelves or may be built into a cabinet when it is originally manufactured. In either case, the storage device 80 should include a base 84, a front 86, a back 88 and at least one panel 90.

Figure 9:
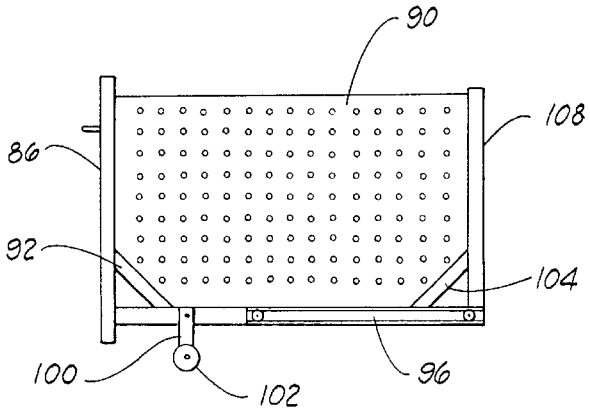
FIG. 9 is an elevational view of the cabinet storage device of FIG. 7.

The base 84 is slidingly attached to the cabinet 82 by one or more slide brackets such as bottom slide bracket 94, or side slide bracket 96 (FIG. 9). The slide brackets 94 or 96 are attached to allow the base 84 to be rolled back into the cabinet in a storage position or to be extended horizontally outward from the cabinet 82 to allow easy access to items which may be stored in the storage device 80.

Preferably means is provided for supporting the storage device 80 when it is in the extended position, such as is shown in FIG. 7. The preferred means includes one or more support members attached to either the slide brackets or to the base. The preferred support member is shown in FIG. 7 and includes a retractable arm 100 and a wheel 102. The arm 100 is spring loaded so when the storage device is extended it will spring down to provide support for the front portion of the storage device 100. When the storage device is pushed back to the storage position the arm engages a portion of the cabinet 82 and is folded back up. Preferably a wheel 102 is attached to the distal end of the arm, that is, the portion of the arm furthest from the base when the arm 100 is in the extended position. In this way, the wheel 102 will engage the floor as soon as the storage device is partially extended and will support the storage device as it is further extended. Thus, the use of a wheel such as wheel 102 allows for easy extension of the device while simultaneously supporting the storage device.

The front 86 preferably has a decorative face which matches the other cabinet drawers and doors in the cabinet. The front should be securely attached to the base 84 and braces such as front brace 92 may be employed to enhance the strength of the connection between the front 86 and the base 84. While brace 92 is the preferred type of brace other suitable braces may be used and brace 92 should be considered as an example and not as a limitation.

Similarly the back 88 should be securely attached to the bottom 84. As with the front, braces may be used to ensure a solid connection. Corner braces 104 and 106 are shown in FIG. 7 as one way to enhance the connection between the bottom 84 and the back 88. Such corner braces are preferred since they are easy to attach, inexpensive and provide strong support. However, as discussed with the front brace 92, other suitable braces may be employed.

As previously mentioned, the storage device includes at least one panel 90. The panel 90 is sized and adapted to fit between the front 86 and the back 88 and to stand in a generally vertical position. The panel 90 includes means for attaching items thereto. For example, and not limitation, the panel may include a plurality of holes 91 for receiving hooks 93 or hanging baskets (not shown). By using a plurality of holes and movable hooks and baskets, items may be arranged on the panel 90. While only one panel 90 is shown, several panels may be used, and preferably the panel or panels are connected in such a manner that they may be moved, or even removed. One suitable means for movably attaching the panels is to provide pairs of grooves (such as grooves 108 and 110) in the front and back 86 and 88. Additional pairs of grooves, such as groove pairs 112–114 and 116–118, may be provided to allow one to move a panel to different locations. Such would be advantageous if one wanted to place large items on one side of the panel and smaller items on the other. For example, one may wish to use hooks to hand large pans on one side and small baskets to hold silverware on the other.

As with the previous embodiment, the panel 90 may be made from a variety of materials such as wood, plastic or metal. However, metal is the preferred material due to its strength and durability, and more preferably the panel 90 is made from stainless steel.

Figure 8:
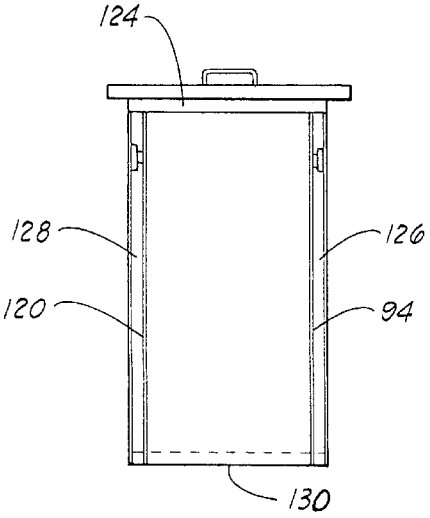
FIG. 8 is a bottom view of the cabinet storage device of FIG. 7.

FIG. 8 shows a bottom plan view of the storage device 80. In this figure the storage device 80 is shown with a pair of bottom slide brackets bottom slide brackets 94 and 120. In addition, the bottom is surrounded by a metal frame having a front 124, left and right sides 126 & 128 and a rear. This frame may be utilized to add additional strength and support to the bottom 84.

FIG. 9 shows an elevational view of the storage device 80 removed from the cabinet 82. The retractable arm 100 is in the extended or supporting position and one possible arrangement of holes in the panel 90 is also shown.

In operation, this embodiment of the storage device allows a user to extend the device 80 generally horizontally to the extended position. The panel 90 may then be placed between a pair of grooves depending on the size of the items to be stored. The user may then set the hooks 93, baskets or other holding devices in appropriate positions for the items to be stored. The items may then be placed on or in position and the storage device closed until the items are needed.

Referring again to FIG. 7, the storage device may be electrically operated. This may be accomplished by securing an electric motor 51 to the cabinet 82 such that a gear drive on the motor 51 will engage a set of gears 53 mounted on the base. The motor may be activated by a switch or button 57 which is electrically connected to the motor 51 by a wire 55. The button 57 may be located near the drawer as is shown in FIG. 7, or may be located on a remote panel.

Changes may be made in the combinations, operations and arrangements of the various parts and elements described herein without departing from the spirit and scope of the invention as defined in the following claims.

I claim:

1. A cabinet storage device comprising:

a base slidingly attached to a cabinet so that the base is movable outwardly from a storage position to an extended position, the storage position placing the sliding base generally inside the cabinet and the extended position displacing the sliding base horizontally outward from the cabinet;

a front having an upper end and lower end, wherein the lower end is secured to the base and extends upwardly therefrom to the upper end;

a back having an upper end and a lower end, wherein the lower end is secured to the base and extends upwardly therefrom to the upper end;

one or more generally vertical panels connected to the front and the back, so said generally vertical panels move along with said base from the storage position to the extended position and wherein each panel includes means for attaching items to the panel so easy access to said attaching means is provided when said base is in an extended position; and further comprising at least one support means to provide additional support for the base when the base is extended outwardly from the cabinet, wherein the support means comprises: a retractable arm having two ends, one end being pivotally connected to the cabinet storage device so the arm extends downwardly from the base to the second end when the arm is in the extended position, wherein the arm pivots upwardly to a storage position when the base is in the storage position.

2. The cabinet storage device of claim 1 further comprising a wheel rotatably connected to the other end of the arm.

3. The cabinet storage device of claim 2 wherein the means for attaching items to the panel comprises: a plurality of holes in each panel; and one or more removable hooks, each hook being sized and shaped to attach to one or more of the holes in a panel and to support items hung therefrom.

4. The cabinet storage device of claim 3 wherein the means for attaching items to the panel comprises: a plurality of holes in each panel for attaching one or more removable baskets, wherein each basket has protrusions being sized and shaped to attach to one or more of the holes in a panel and to support items placed therein.

5. The cabinet storage device of claim 1 wherein the front includes grooves therein for receiving and holding said one or more generally vertical panels and the rear includes grooves therein for receiving and holding one or more generally vertical panels, and wherein the one or more generally vertical panels slide in between said grooves to connect the one or more panels to the cabinet storage device or slide out of said grooves to remove the one or more panels from the cabinet storage device.

* * * * *